US010688684B2

(12) United States Patent
Foppe

(10) Patent No.: US 10,688,684 B2
(45) Date of Patent: Jun. 23, 2020

(54) CORE PULLER DEVICE FOR A BLOCK MACHINE, BLOCK MACHINE AND METHOD FOR THE PREPARATION OF SHAPED STONES

(71) Applicant: Rekers GmbH Maschinen-und Anlagenbau, Spelle (DE)

(72) Inventor: Norbert Foppe, Spelle (DE)

(73) Assignee: REKERS GMBH MASCHINEN-UND ANLAGENBAU, Spelle (DE)

( * ) Notice: Subject to any disclaimer, the term of this patent is extended or adjusted under 35 U.S.C. 154(b) by 351 days.

(21) Appl. No.: 15/474,550

(22) Filed: Mar. 30, 2017

(65) Prior Publication Data

US 2017/0282403 A1 Oct. 5, 2017

(30) Foreign Application Priority Data

Apr. 4, 2016 (DE) ..... 10 2016 205 554

(51) Int. Cl.
*B28B 7/28* (2006.01)

(52) U.S. Cl.
CPC ..... *B28B 7/285* (2013.01)

(58) Field of Classification Search
CPC ..... B28B 7/285
USPC ..... 425/468
See application file for complete search history.

(56) References Cited

U.S. PATENT DOCUMENTS 3,642,419 A * 2/1972 Toksvig ..... B28B 7/28 425/457
3,761,198 A * 9/1973 Hehl ..... B29C 45/10 425/192 R
3,829,265 A 8/1974 Holm
4,278,378 A * 7/1981 Milholen ..... B65G 57/26 198/434
4,427,355 A * 1/1984 Vatterott ..... B28B 7/16 425/156
4,430,533 A * 2/1984 Vatterott ..... H01H 13/18 200/16 B
4,520,880 A * 6/1985 Saito ..... E21C 47/10 175/51
4,652,228 A * 3/1987 Cousin ..... B28B 5/025 264/71
4,753,590 A * 6/1988 Milholen ..... B65G 47/252 198/433

(Continued)

FOREIGN PATENT DOCUMENTS

CH 47 075 A 5/1910
DE 37 10 122 A1 3/1988

(Continued)

*Primary Examiner* — Seyed Masoud Malekzadeh
*Assistant Examiner* — Guy F Mongelli
(74) *Attorney, Agent, or Firm* — Baker & Hostetler LLP

(57) ABSTRACT

A core puller device for a block machine, a block machine with such a device as well as a method for the preparation of shaped stones in which at least one core puller arranged on the sliding facility of the core puller device is temporarily inserted into a stone mould of the block machine and retracted after a packing operation in the block machine are provided. Here, the core puller device is constructed or the method is configured such that the operative connection between the at least one core puller and the sliding facility of the core puller device is temporarily neutralized.

22 Claims, 11 Drawing Sheets

(56) References Cited

U.S. PATENT DOCUMENTS

| | | | | |
|---|---|---|---|---|
| 5,183,616 | A * | 2/1993 | Hedrick | B28B 3/02 249/123 |
| 5,234,337 | A * | 8/1993 | Hehl | B29C 45/332 425/589 |
| 6,517,337 | B1 * | 2/2003 | Hehl | B29C 45/07 425/190 |
| 7,300,271 | B2 * | 11/2007 | Parmenter | B29C 45/2606 425/190 |
| 2004/0032043 | A1 * | 2/2004 | Woolford | B28B 7/20 264/71 |
| 2004/0130047 | A1 * | 7/2004 | Skidmore | B28B 7/0085 264/35 |
| 2004/0165962 | A1 * | 8/2004 | Shimasaku | B28B 5/025 264/71 |
| 2008/0156963 | A1 * | 7/2008 | Davies | E21C 47/10 175/51 |
| 2008/0174049 | A1 * | 7/2008 | Hammer | B65G 57/26 198/434 |
| 2010/0092706 | A1 * | 4/2010 | Clarke | B29C 45/2606 425/190 |
| 2012/0139163 | A1 * | 6/2012 | Garfinkel | B28B 7/20 264/71 |
| 2015/0151450 | A1 * | 6/2015 | Matys | B28B 7/28 425/457 |

FOREIGN PATENT DOCUMENTS

| | | |
|---|---|---|
| DE | 38 03 781 A1 | 1/1989 |
| GB | 2 379 902 A | 3/2003 |

* cited by examiner

CORE PULLER DEVICE FOR A BLOCK MACHINE, BLOCK MACHINE AND METHOD FOR THE PREPARATION OF SHAPED STONES

CROSS-REFERENCE TO RELATED APPLICATIONS

This application claims priority to foreign German patent application No. DE 10 2016 205 554.2, filed on Apr. 4, 2016, the disclosure of which is incorporated by reference in its entirety.

FIELD OF THE INVENTION

The present invention relates to a core puller device for a block machine and a block machine having a core puller device. Here, the core puller device has at least one core puller to generate a recess in at least one shaped stone to be prepared with the block machine that can be inserted into and removed from a stone mould of the block machine by means of a disposed sliding facility. Furthermore, the invention relates to a method for the preparation of shaped stones with a block machine having a core puller device in which at least one core puller attached to a sliding facility of the core puller device is temporarily inserted into a stone mould of the block machine and is retracted again after a packing operation in the block machine.

BACKGROUND

Basically, such block machines, core puller devices for block machines, but also methods for the preparation of shaped stones are known. Here, the core puller devices are for the generation of at least one recess in at least one shaped stone to be prepared in a block machine. Here, a particularly common field of application is the preparation of concrete blocks that are used e.g. as paving blocks, masonry blocks, or building blocks. However, for the object of the invention all of further shaped stones of any shape and any material are also relevant for which a recess has to be generated and that undergo a packing operation during preparation. Here, the recesses can take over several functions, such as for example weight saving, insulation, or a better handling of the shaped stones in the further manufacturing process.

To generate the recess such a core puller device has at least one core puller that is often laterally inserted into the stone mould of the block machine and is again retracted after a packing process. Generally, the core puller thus is formed as an elongated metal rod. However, the core puller can also have a different shape or nature depending on what recess (es) is/are to be achieved in the shaped stone or shaped stones and depending on how the stone mould or block machine, respectively is configured.

By the use of several core pullers several shaped stones can be provided with recesses. Also, it is possible to generate several recesses in one shaped stone or in several shaped stones at the same time. In case that several shaped stones are to be prepared at the same time the stone mould has several moulding cavities that are configured such that they are penetrated by one core puller behind the other and/or also by further core pullers lying next to each other.

In order to insert the core pullers into the stone mould of the block machine these are often attached to a sliding facility. This is suitably attached to a rack and moves relative to the stone mould. It is also conceivable that the sliding facility is directly arranged on the block machine. However, also free-standing solutions are possible in which the core puller devices have their own rack and virtually can be placed next to the block machines.

Here, the core pullers typically are firmly and generally permanently connected to the sliding facility in order to be able to quickly, safely, and directly insert them into the stone mould and remove them again after the packing operation.

During the packing operation the stone mould is generally set vibrating in order to achieve a uniform packing of the material in the stone mould. Here, it has been shown that especially when using a core puller device the packing not always is to the full satisfaction. This is because there is no quite uniform packing in the material in the stone mould.

The reason for this phenomenon has already been recognized in the past to be the core puller device and provided it with dampers. However, tests of the applicant have shown that the results are still unsatisfactory, since in individual cases undesirably packed shaped stones are made.

SUMMARY OF THE INVENTION

Thus, the invention is based on the problem to provide a core puller device for a block machine, a block machine having such a core puller device and a method for the preparation of shaped stones with which high-quality shaped stones can be produced even more efficiently.

The solution of the problem is achieved with the device according to claim 1, the block machine according to claim 18, and a method according to claim 19. Suitable developments of the invention are given in the sub-claims.

That is, the core puller device for a block machine according to the invention or the block machine having such a core puller device is characterized in that the operative connection between the sliding facility and the at least one core puller can be neutralized at least temporarily.

This is based on the findings that especially the one-sided mount of the core pullers to the sliding facility is a problem. Namely, by the one-sided mount of the core pullers in the core puller device of a conventional construction there is introduced a one-sided force component into the stone mould of the block machine during packing. This results in a non-uniform packing in the material of the shaped stones and increases the risk that the shaped stones after the manufacturing process can have different densities and heights, but also cracks on the surfaces.

Examinations of the applicant have shown that certainly this effect can be reduced, but not completely eliminated by means of the arrangement of dampers on the core puller device. Even when using dampers there remains an operative connection between the core pullers and the residual core puller device. And this is precisely where the invention starts by now creating a core puller device in which exactly this operative connection at least temporarily (suitably at least for the duration of packing) is neutralized.

Here, by operative connection there is understood any connection between the sliding facility and the at least one core puller by which a force component between the sliding facility on the one hand and the core puller or core pullers on the other hand can be exchanged.

That is, preferably the core puller or core pullers are arranged on the sliding facility in an uncouplable manner. So, the at least one core puller in the uncoupled state during packing can freely move with the stone mould and at best in this state lies symmetrically within the stone mould. In this way the center of gravity of the core puller inserted into the stone mould shifts into the interior of the stone mould and thus, even closer to the center of gravity of the stone mould.

The result is an even more uniform vibration during the packing operation. In the end, there can be produced shaped stones of even higher quality and the number of shaped stones that do not meet the highest quality requirements can be reduced.

A further positive effect is the protection of the core puller device or the block machine. By the elimination of the one-sided force component the stone mould uncoupled from the sliding facility can perform arbitrary processing steps. Accordingly, unnecessary friction and wear by an uneven load on different components of the block machine can be avoided.

Suitably, the core puller device has several core pullers extending in parallel. In this way it is possible to even more efficiently prepare several recesses or shaped stones, respectively. By the parallel arrangement several core pullers can be moved very easily by means of a common sliding facility. Here, the distances between the core pullers can be variably adjustable so that a free configuration of the positions where the recesses are to be generated in the shaped stones is possible.

It is advantageous when the sliding facility has a core puller accommodation that is configured such that it at least partially surrounds at least one end of a core puller, preferably the ends of all core pullers it encloses, each with a clearance. Here, the core puller accommodation can be configured in any shape. It is only important that by surrounding upon insertion and retraction of the at least one core puller an operative connection between core puller and sliding facility can be made such that the at least one core puller can be moved into and out of the stone mould. Thus, the surrounding or enclosing of the end of the respective core puller need not be completely. A partial surrounding or simple clamping is often enough. Thus, the term surrounding here and in the following is to be understood broadly.

On the other hand, by providing a clearance between sliding facility or core puller accommodation and the end of the at least one core puller it is simply ensured that the operative connection can be specifically neutralized and safely re-established. So, the clearance can suitably temporarily be neutralized or at least reduced in order to specifically re-establish or unblock it later as required for neutralizing the operative connection.

Preferably, the clearance between core puller accommodation and each core puller it surrounds is formed so large that the core puller while being inserted into the stone mould of the block machine can freely vibrate with the stone mould at its end surrounded by the core puller accommodation during a packing operation. Thus, by a correspondingly large clearance it can be ensured that the core puller accommodation does not come into contact with the core puller accommodation during the packing operation. The result is that the core puller can freely vibrate with the stone mould and the packing operation is not impaired. With a sufficiently large clearance even short contacts between core puller accommodation and core puller are avoided. Thus, the center of gravity of the core puller is not changed and further force components cannot impair the stone mould and vibration. Accordingly, the recess in the shaped stone can be generated even more uniform and friction and wear within the block machine are reduced.

Suitably, the at least one core puller at its end surrounded by the core puller accommodation has an abutment that is preferably formed as a collar. The abutment serves as a point of action between core puller and core puller accommodation. The abutment has the advantage that the core puller accommodation can make the operative connection between sliding facility and core puller even better. Here, the abutment can have any shape that especially when retracting ensures an effective operative connection.

Preferably, the abutment is part of a sleeve-like core puller mount attached to the end of the core puller. Here, the sleeve-like core puller mount can be slipped over and/or fixed to the end of the core puller. This has the advantage that the operative connection between sliding facility and core puller does not directly act on the core puller, but on the core puller mount. If the abutment or collar has to be substituted due to wear or for other reasons it is not necessary to replace the entire core puller. In this case, only the core puller mount can be renewed. Also, by the core puller mount conventional core pullers can be retrofitted.

It is of advantage when the abutment for making the operative connection is formed such that the abutment abuts on the core puller accommodation when the sliding facility retracts the at least one core puller from the stone mould. Because the core puller accommodation surrounds the core puller with a certain clearance the operative connection between the abutment and the core puller accommodation is made when the core puller is retracted from the stone mould. Here, the abutment can be designed in any shape, such as for example round or polygonal, corresponding to the design of the core puller accommodation. For example, the abutment can be designed such that the cross section radius is larger than the cross section radius of the remaining core puller. In this way it is possible that the surrounding core puller accommodation abuts on the abutment when retracting the core puller from the stone mould.

Suitably, the core puller accommodation has a coulisse-like configured draw plate on which the abutment of a core puller arranged in the core puller accommodation at least partially can abut. Here, the coulisse of the draw plate can be configured in any desired shape. A perforated plate for example would be conceivable or an upward open serrated and/or round form. Here, it would also be possible that the draw plate completely encloses the one core puller or even surrounds it only on one side. Depending on how the draw plate is configured the core puller completely or only partially abuts.

It is of advantage when the draw plate is formed as a crest-like coulisse with several crests on the crests of which the abutments of several, preferably all core pullers arranged in the core puller accommodation at least partially abut. By the crest-like configuration of the draw plate the individual core pullers can be taken up between the individual crests. Here, the crests can be formed in regular and irregular distances along the draw plate. Serrated, straight or even round-shaped crests would be conceivable between which the individual core pullers extend. Once the abutments abut on the crests an operative connection is established and the core pullers can be retracted from the stone mould. Because several or even all core pullers in the core puller accommodation at least partially abut, it is possible to achieve the retraction in a very simple manner simultaneously, smoothly, and efficiently.

Preferably, the core puller accommodation has a pressure plate on which the front side of the end of a core puller arranged in the core puller accommodation then at least partially can abut when the core puller is inserted into the stone mould by the sliding facility. Particularly when the core puller accommodation has a draw plate effective to retract the at least one core puller, the core puller accommodation has to come into contact therewith for insertion of the core puller. Then, the required operative connection between the core puller accommodation and the core puller is established by the pressure plate. Here, the pressure plate is configured such that an effective operative connection between the two components is achieved. Here, it can be of any material and basically any shape. Accordingly, the term plate also is to be interpreted broadly. It is only important that it is sufficiently stable in order to transmit the required force to the core puller.

Suitably, at least one bearing is attached to the pressure plate of the core puller accommodation to reduce the friction between the core puller and the core puller accommodation. The bearing can be constructed in any manner. For example, ball roller bearings, slide bearings, or the like would be conceivable. Also, it can be formed of one or even individual components that contact(s) several core pullers. It is only important that it effectively and permanently reduces friction. Also several bearings can be arranged at the pressure plate to come into contact with one single core puller.

It is of advantage when the core puller device has at least one core puller bearing that is movable, preferably in vertical direction. The core puller bearing has the advantage that it can bear and hold the core puller in the vertical direction in a certain position. This is crucial when the core puller is only partially surrounded by the core puller accommodation with a clearance and especially in the vertical direction cannot be held by the core puller accommodation alone at all. Therefore, in spite of this, it can be ensured that the core puller is properly positioned and held in the vertical direction. Because the core puller bearing is movable in the vertical direction also the altitude of the core puller with respect to the stone mould can variably be adjusted. It is also possible to selectively lower the core puller bearing when the core puller is supported by another component, for example to create additional space.

Suitably, the movable core puller bearing is formed as a lever arranged at the sliding facility with which preferably all of the core pullers arranged in the core puller accommodation can be lifted simultaneously. The lever can have a regular, but also irregular shape. For example, it is formed with a continuously rectangular cross section. However, all further cross-sectional shapes that ensure a vertical bearing are also possible. Because the lever can simultaneously lift all of the arranged core pullers it is possible to simplify the manufacturing process and to simultaneously and uniformly position all the core pullers along a line with one component. Also, a bearing in the form of a lever has the advantage that it can be lifted and lowered laterally via drives. So, the region in which the core pullers extend remains free from installations.

It is of advantage when the core puller device has a movable core puller guide that is preferably swivel-mounted to the rack of the core puller device. Here, the movable core puller guide supports the at least one core puller preferably in the vertical direction and guides the at least one core puller simultaneously, sensibly in the horizontal direction. Because the core puller guide is arranged on the rack of the core puller device it holds the position during the insertion of the core puller even if the sliding facility is moved. By means of the swivel-mount to the rack the core puller guide can be swiveled away downwards as soon as it is no longer needed. For example, this is the case when the at least one core puller has been at least partially inserted into the stone mould.

Preferably, the core puller guide is formed as an upwardly open coulisse in which at least one core puller, preferably all of the core pullers, is/are laterally guided and supported in height. Here, the open coulisse can be configured in any shape and manner. For example, the coulisse can have round depressions and/or also serrated forms by which one core puller each is supported and guided. Such a configuration of the core puller guide ensures that the core puller(s) are positioned in an aligned position to the openings for receiving the respective core puller in the stone mould during insertion and retraction. For example, the core puller(s) can slide along within the depressions whereby bearing and guidance is ensured.

Suitably, the sliding facility, the core puller bearing, and/or the core puller guide each can be moved motorically by an own drive. In this way it is possible to perform the manufacturing process completely automated with drives of any type being usable. Electric, hydraulic, or also pneumatic drives that have already proven useful in this context are conceivable.

It is of advantage when the core puller device has a height adjustment that is preferably formed as a movable lifting rack with which the height of the core puller device, especially that of the at least one, preferably of all core pullers, can be adjusted relative to a block machine, especially to its stone mould.

With the height adjustment it is possible to exactly bring the core puller device in the required vertical position to insert the core pullers into the openings of the stone mould provided for that. This has the advantage that a core puller device can also be used with different block machines. Thus, it is also possible that the core puller device can be arranged as a separate component next to the remaining block machine. It would also be conceivable that the stone mould of the block machine is exchanged and has another height. Thus, major reconstruction works on the block machine can be avoided by adjusting the proper height only by the height adjustment. For adjusting the height, for example a manual device, but also a drive could be used.

Suitably, the sliding facility is formed as a slide car that is preferably moveable by means of guide rails attached to the rack of the core puller device in a guided manner. The slide car has the advantage that a usual guide rail system can be used. In this way, a precisely defined movement toward the stone mould and back again is given. For example, the guide rails can be fixed to the rack laterally to, but also below the slide car.

Additionally, the problem is solved by a block machine having a core puller device as described above. Then, the block machine itself has the above-described advantages according to the invention in the preparation of shaped stones with at least one recess.

The problem is also solved by a method for the preparation of shaped stones with a block machine having a core puller device in which at least one core puller arranged on a sliding facility of the core puller device is temporarily inserted into a stone mould of the block machine and retracted after a packing operation in the block machine and the operative connection between the at least one core puller and the sliding facility of the core puller device is neutralized temporarily. This has the advantage that the concerned core puller during various process steps is completely free from influences from the core puller device and especially can freely be moved together with the stone mould. After the operative connection has been neutralized the center of gravity of the core puller moves from outside of the stone mould towards the center of gravity of the stone mould. Moreover, additional force components onto the stone mould are prevented by the core puller device. This results in more uniform vibrations during the packing of the material of the shaped stones and overall better stone qualities.

Unnecessary friction and wear by an uneven load of various components of the block machine are also avoided.

In a further development, the operative connection during the packing operation is neutralized such that the end of the at least one core puller that faces the core puller device can freely vibrate in the block machine. During the packing operation generally the stone mould of the block machine is set vibrating. By neutralizing the operative connection during this process step it is observed in the prior art that the one-sided force component is neutralized by the core puller device. In this way the packing operation can be performed even more uniform and shaped stones of even higher quality are produced.

Preferably, the operative connection is neutralized and established by traversing and/or swiveling a part of the core puller device, especially a core puller bearing and/or a core puller guide. This has the advantage that the operative connection can be neutralized and re-established quickly and without great effort. Here, the corresponding parts of the core puller device can be fixed to the rack or to the sliding facility. In this way, the core puller can be supported and/or guided during the insertion and retraction, even though the operative connection between these two steps is neutralized.

In a further development, at least one core puller is at least temporarily vertically supported and/or horizontally guided during the insertion into and/or the retraction from the stone mould by at least one core puller guide. This has the advantage that the core pullers horizontally at the height to be inserted to the stone mould are vertically held in position and horizontally guided. In this way, the core pullers can smoothly be inserted into or retracted from the stone mould, even though the core pullers are attached to the sliding facility such that the operative connection can be neutralized.

Preferably, the at least one core puller is temporarily vertically supported during the insertion into or retraction from the stone mould by at least one core puller bearing, wherein the core puller bearing is preferably moved together with the sliding facility when inserting and/or retracting the core puller. Because the core puller bearing is moved together with the sliding facility the concerned core puller is also safely held during the movement.

In a further development, the vertical position of the core puller device relative to the stone mould is adjusted by means of a height adjustment before the at least one core puller is inserted into the stone mould. This has the advantage that the core puller device can easily be adjusted to different altitudes. In this way it is ensured that they can be inserted into the respective stone mould exactly at the right height.

BRIEF DESCRIPTION OF THE DRAWINGS

In the following the invention is explained in detail by way of various examples. Here.

DETAILED DESCRIPTION

Figure 1:
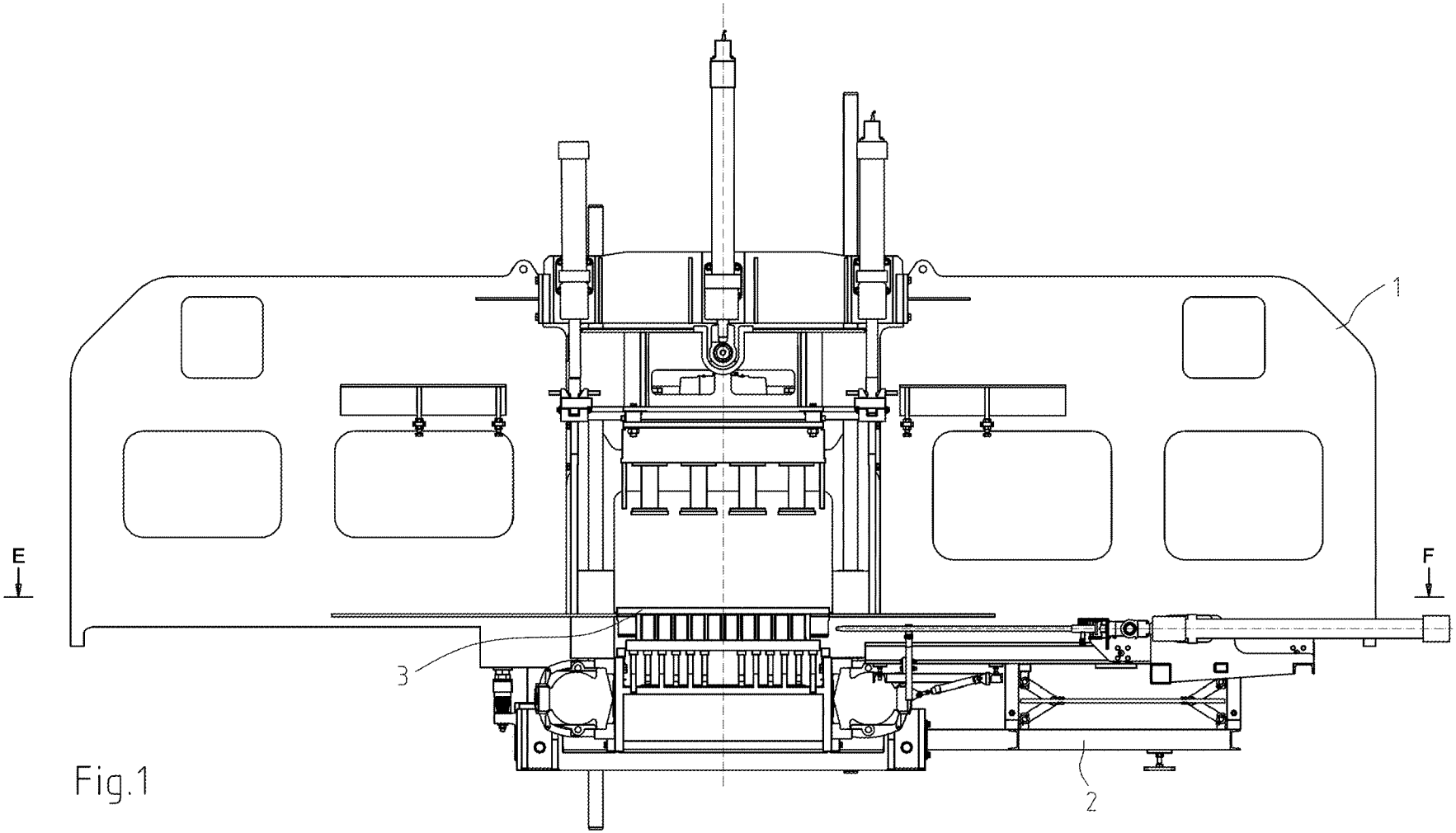
FIG. 1: schematically shows a view of a block machine with a core puller device according to a first embodiment according to the invention.

FIG. 1 shows a block machine 1 with a stone mould 2 and a core puller device 3 for the preparation of shaped stones according to a first embodiment.

Figure 2:
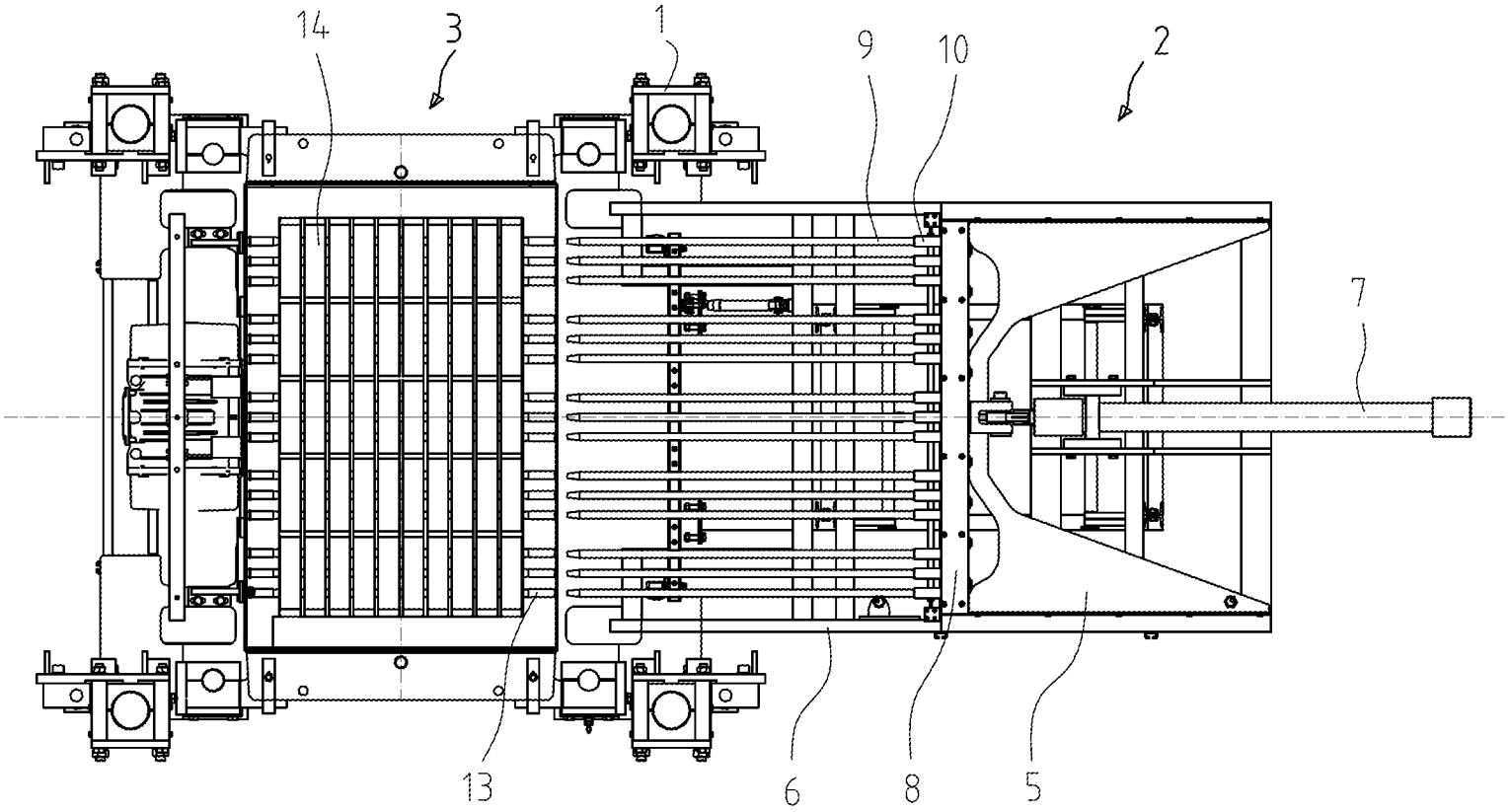
FIG. 2: schematically shows a plan view of a part of the block machine with a core puller device shown in FIG. 1 along the section E-F outlined in FIG. 1.
Figure 3:
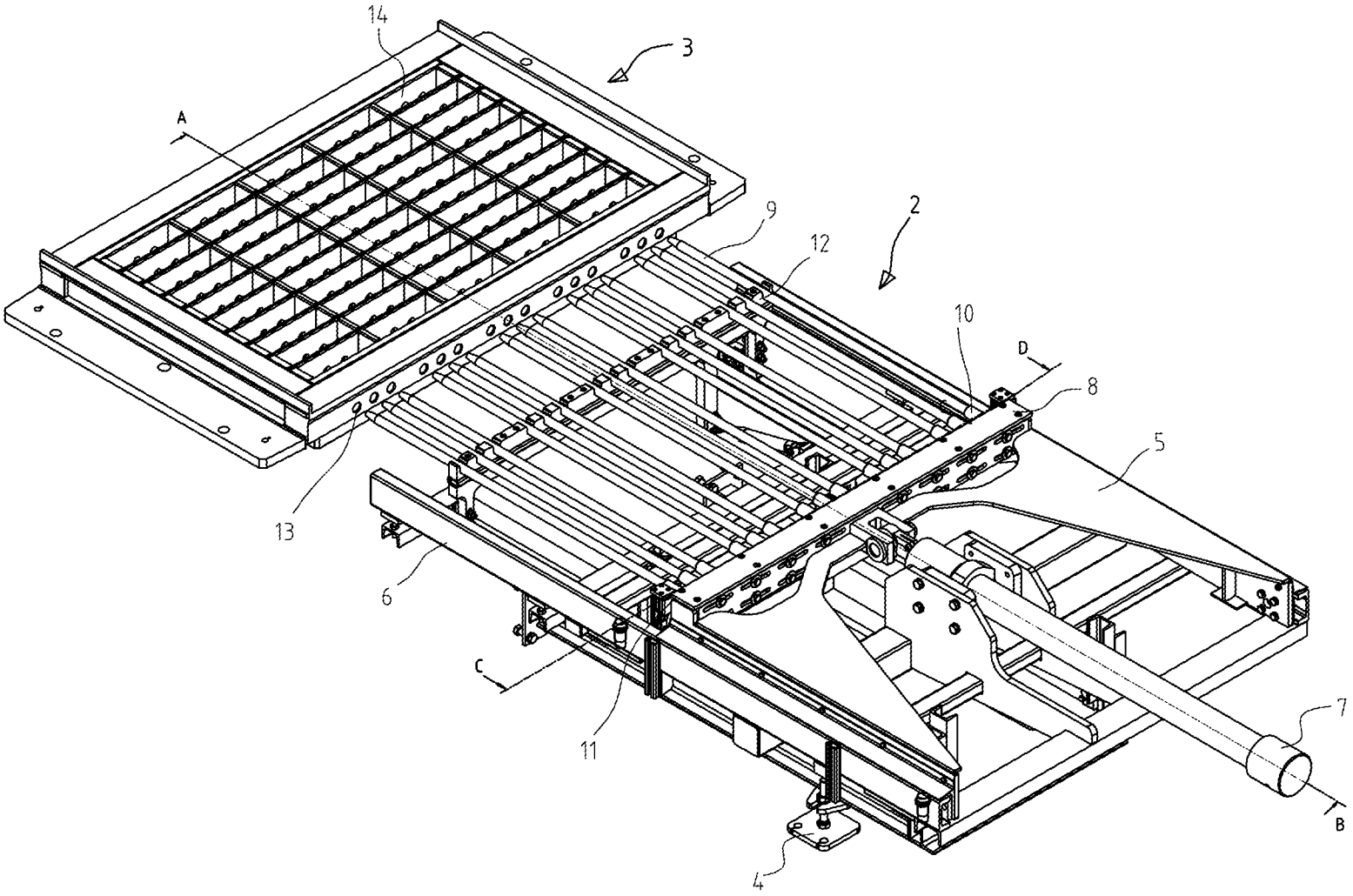
FIG. 3: schematically shows a perspective view of the core puller device shown in FIG. 1 together with a stone mould.
Figure 4:
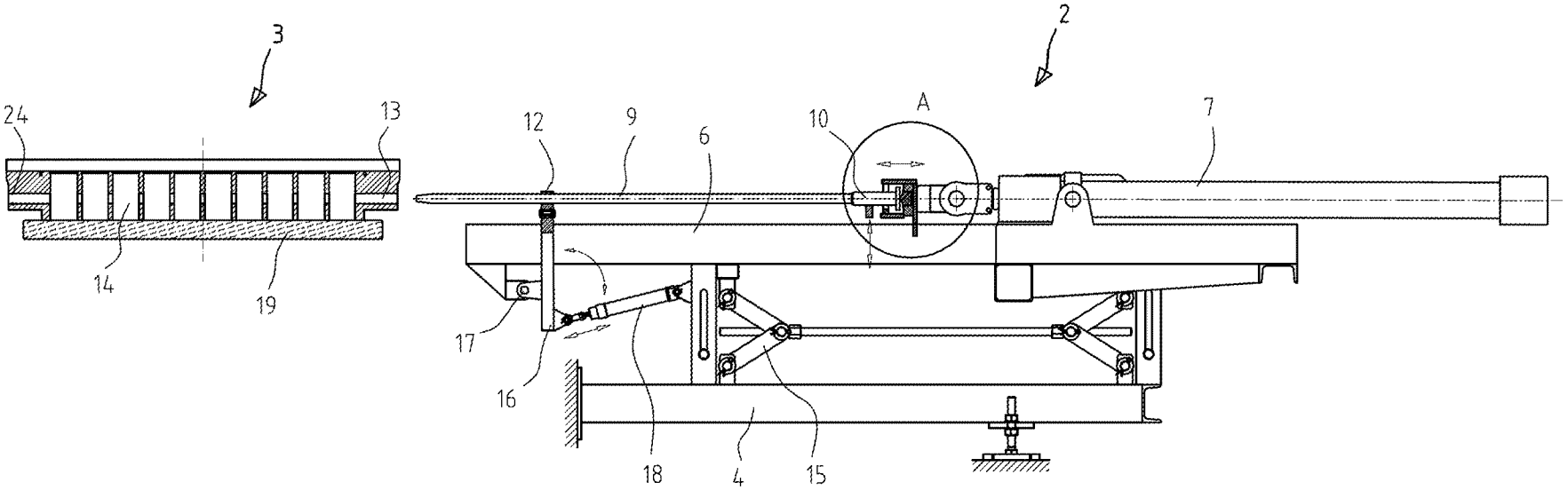
FIG. 4: schematically shows a cross section of the core puller device and stone mould shown in FIG. 3 along the section A-B outlined in FIG. 3 shortly before the core pullers are inserted into the stone mould.

As particularly illustrated in FIG. 3 and FIG. 4, the core puller device 2 in the present embodiment has a rack 4 that is firmly connected to the ground and the block machine 1. A sliding facility 5, here formed as a slide car, is attached to the rack 4. As can well be seen especially in FIG. 2 and FIG. 3, this is movably guided along two guide rails 6. Here, the slide car 5 is driven by a drive 7 that can be formed as a hydraulic cylinder, as shown here.

The slide car 5 further has a core puller accommodation 8 to which parallel core pullers 9 via core puller mounts 10 arranged thereto are arranged such that the operative connection between the slide car 5 and the core pullers 9 can at least temporarily be neutralized. Here, the core pullers 9 are vertically supported by a movable core puller bearing 11 and by a movable core puller guide 12. The latter, in addition to the vertical support also causes a horizontal guidance of the core pullers 9. In this way, the core pullers 9 can be horizontally held in position to be inserted into lateral openings 13 of the stone mould 3. In the example shown here, the stone mould 3 has fife parallel rows with ten moulding cavities 14 each that constitute the form for the shaped stones made. Fifteen core pullers 9 in total are arranged on the slide car 5 in groups of three, wherein one group each can be inserted into one row of the moulding cavities 14. However, it should be noted that any other designs of the stone mould of course are also conceivable in the meaning of the invention.

As shown in FIG. 4, the core puller device 2 has a height adjustment 15, here formed as a lifting rack, that is arranged between the rack 4 and the remaining core puller device 2. Thus, all the other components of the core puller device 2 can be positioned in their height relative to the rack 4. In this way, the optimum position of the core puller device 2 and the core pullers 9 relative to the stone mould 3 can be adjusted with its bolster plate 19 and the core pullers 9 can be inserted into the openings 13 of the stone mould 3.

Figure 5:
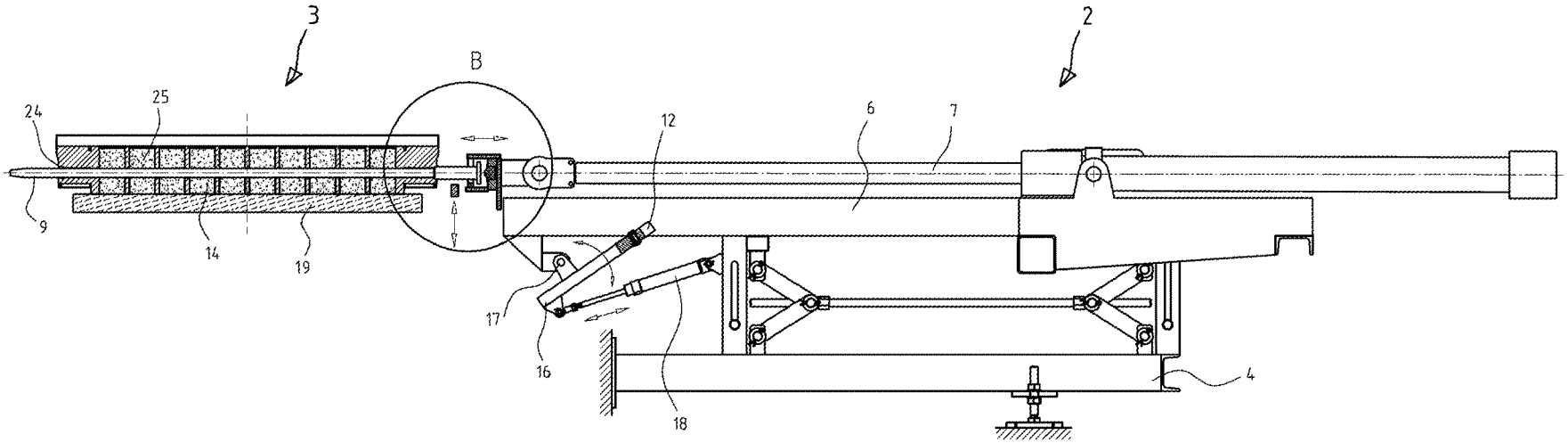
FIG. 5: schematically shows a cross section corresponding to FIG. 4 in a state where the core pullers are inserted into the stone mould.

The core puller guide 12 is fixed to the rack 4. Here, the core puller guide 12 is movably supported about the rotational point 17 via a swivel lever 16. Here, the position of the core puller guide 12 can be adjusted by a drive 18, here for example formed as a pneumatic cylinder. In this way, as shown in FIG. 5, the core puller guide 12 can be swiveled away downwards as soon as the pneumatic cylinder 17 extends its piston. When the slide car 5 with the core pullers 9 attached thereto travels toward the stone mould 3 the core puller guide 12 holds its position and thus, represents a firm guide and vertical support for the core pullers 9. Here, the core puller guide 12 is formed as an upwardly open coulisse that has several depressions, as shown in FIG. 3. The core pullers 9 are supported within these depressions and guided toward the stone.

Figure 10:
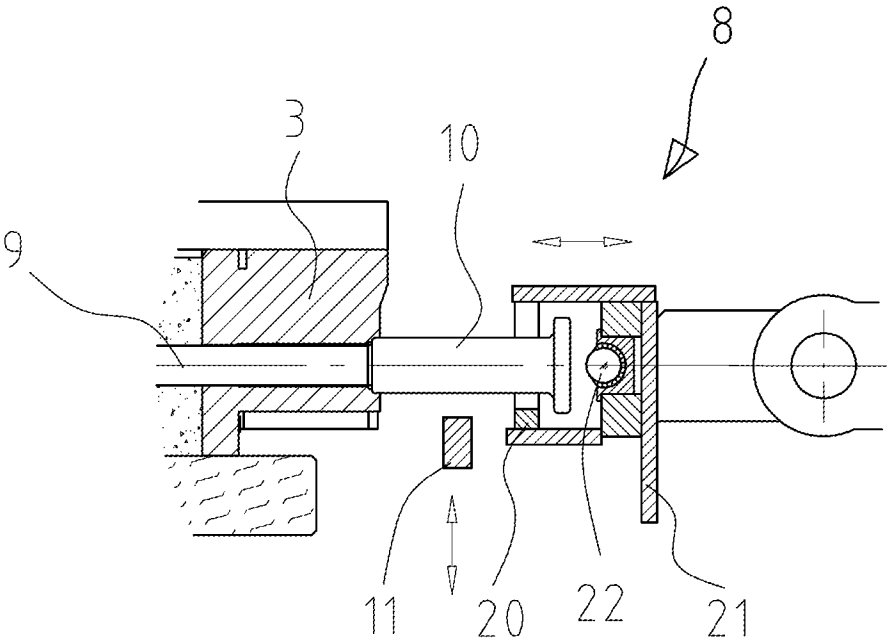
FIG. 10: schematically shows the core puller accommodation of detail B of the core puller device shown in FIG. 5.

As illustrated in FIG. 10, the sleeve-like core puller mount 10 is attached to the core puller 9 that has an abutment at the end, in the present case exemplarily formed as a collar.

The core puller accommodation 8 as far as it is concerned is configured such that a spatial clearance can be established between the core puller accommodation 8 and the core puller mount 10 together with its abutment when the core puller accommodation 8 has been brought into a position suitable for that. At the same time, however the core puller accommodation 8 is also formed such that the abutment of the core puller mount 10 abuts thereto when the operative connection between the core puller and the core puller device is to be re-established. Here, the clearance is dimensioned such that the core puller 9 in the state inserted into the stone mould 3 can freely vibrate therewith during the packing operation.

For inserting and retracting the core puller 9 the core puller accommodation 8 has a draw plate 20 and a pressure plate 21 that are arranged spaced apart such that the clearance is established between these two components. The collar of the core puller mount 10 is located between the draw plate 20 and the pressure plate 21 and thus, comes into contact with these as follows:

When inserting the core puller 9 the pressure plate 21 abuts on the collar and pushes the core puller 9 into the stone mould 3. The pressure plate 21 further has a bearing 22 that is formed as a contact surface to the collar and dampens the impact of the core puller accommodation 8.

Figure 6:
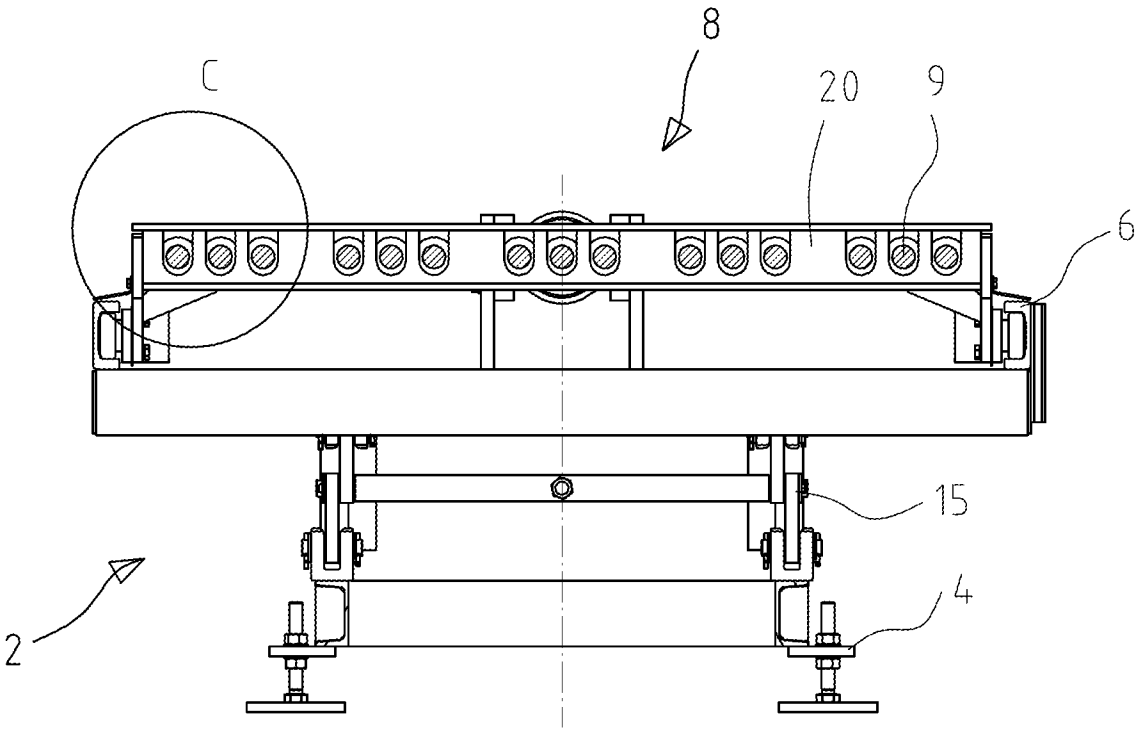
FIG. 6: schematically shows a cross section of the core puller device shown in FIG. 3 along the section C-D outlined in FIG. 3.
Figure 7:
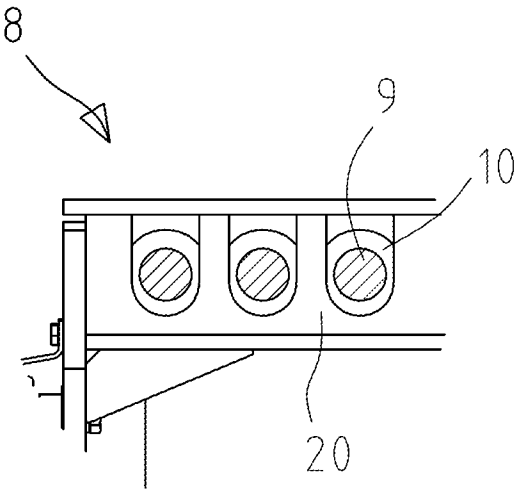
FIG. 7: schematically shows the enlarged detail C of the core puller device shown in FIG. 6.

When retracting the core puller 9 from the stone mould 3 the operative connection is established such that the collar of the core puller mount 10 abuts on the draw plate 20. As shown in FIG. 6, for this purpose the draw plate 20 is configured coulisse-like with several crests to contact the core pullers 9 mainly laterally and below them. FIG. 7 again in detail shows the configuration of the draw plate 20. The draw plate 20 is configured such that it can only come into contact with the collar of the core puller mount 10. The core pullers 9 extend between the crests without radially contacting them.

Figure 11:
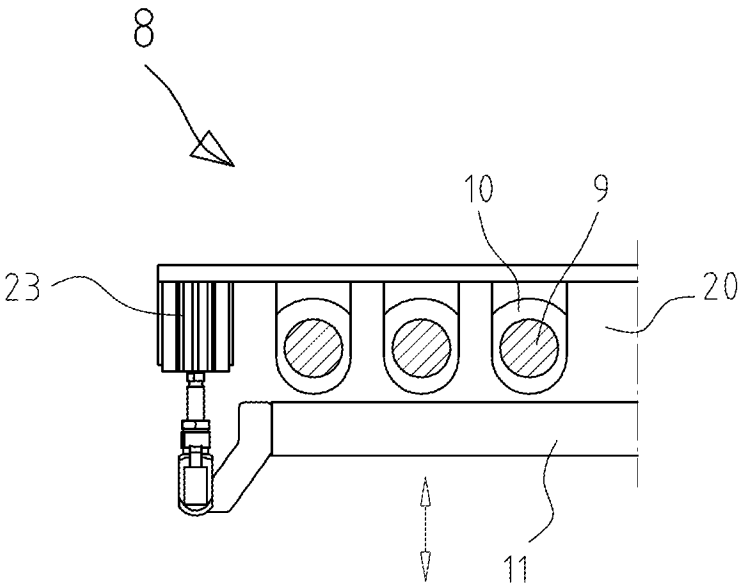
FIG. 11: schematically shows a side view of the core puller accommodation shown in FIG. 10.

During the insertion and retraction of the core pullers 9 these are vertically supported by the movable core puller bearing 11. The core puller bearing 11, as shown in FIG. 11, is formed as a lever. By a drive 23, here exemplarily formed as a pneumatic cylinder, the core puller bearing 11 can vertically be moved and thus, simultaneously lift all core pullers 9 that are arranged in the core puller accommodation 8. Moreover, the core puller bearing 11 is arranged at the slide car 5 and thus, when inserting and retracting the core pullers 9 can also travel toward the stone mould 3 and in the opposite direction. Thus, the core pullers 9 can always be vertically supported at the same place near the core puller accommodation 8. Thus, the core puller accommodation 8 need not take over a vertical support.

In the following there is described a method according to the invention for the preparation of shaped stones according to a first embodiment.

First, the optimum height of the core puller device 2 can be adjusted via the lifting rack 15 shown in FIG. 4 relative to the stone mould 3 of the block machine 1. The core pullers 9 are attached in parallel to the slide car 5 via the core puller accommodation 8 and are positioned outside the stone mould 3. In this state, the core pullers 9 are vertically supported by the core puller bearing 11. Additionally, the core pullers 9 are held in an aligned position opposite to the openings 13 of the stone mould 3 by the core puller guide 12. Slipping out of the core pullers 9 is prevented by the collar at the core puller mount 10.

Figure 9:
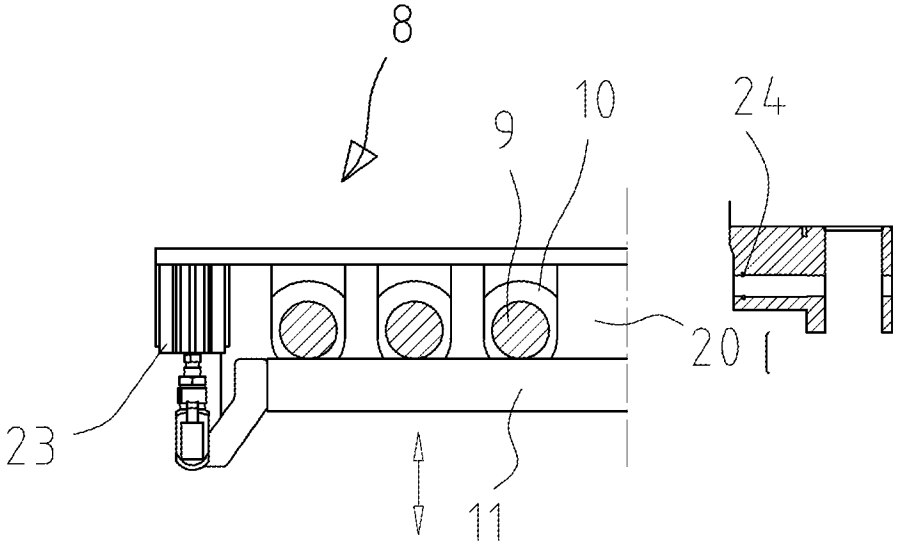
FIG. 9: schematically shows a side view of the core puller accommodation shown in FIG. 8.

As shown in FIG. 4, in the initial position the hydraulic cylinder 7 is in the retracted state. The swivel lever 16 is in an upright position, whereby the core puller guide 12 vertically supports and guides the core pullers 9 in a horizontal position to the openings 13 of the stone mould 3. As shown in FIG. 9, in this state also the core puller bearing 11 is brought into position by the pneumatic cylinder 23 as far as the core pullers 9 near the core puller accommodation 8 rest thereon.

Figure 8:
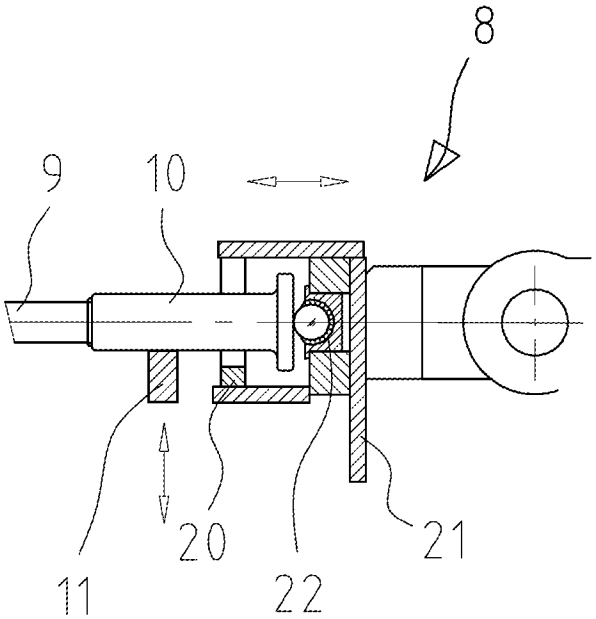
FIG. 8: schematically shows the core puller accommodation of the enlarged detail A of the core puller device shown in FIG. 4.

By extending the hydraulic cylinder 7 now the slide car 5 is moved along the guide rails 6 toward the stone mould 3. In this way, the core pullers 9 guided by the core puller guide 12 are inserted into the stone mould 3. As shown in FIG. 8, the pressure plate 21 abuts on the respective core puller mount 10 via the bearing 22 and thus, establishes an operative connection. Here, the bearing 22 is exemplarily formed as a roller plate with one ball transfer unit per core puller 9 each. Now, the core pullers 9 are pushed into the stone mould 3. Here, the vertical support in the region of the core puller accommodation 8 is only taken over by the core puller bearing 11.

As soon as the core pullers 9 are in the openings 13 of the stone mould 3 and guided therethrough the swivel lever 16 swivels downwards about the rotational point 17. Here, the swivel lever 16 is driven by the pneumatic cylinder 18. In this way, the vertical support and horizontal guidance of the core pullers 9 by the core puller guide 12 are neutralized and taken over by the stone mould 3.

Before the core puller accommodation 8, when further inserted, reaches the stone mould 3 the core puller bearing 11 is lowered by the pneumatic cylinder 23, as shown in FIG. 11. Now, the core pullers 9 are only vertically supported and horizontally guided by the stone mould 3 and built-in retaining rings 24. The core pullers 9 are pushed into the final position by means of the pressure plate 21.

As shown in FIG. 10, thereupon the hydraulic cylinder 7 is retracted to some extent so that the slide car 5 together with the core puller accommodation 8 moves away from the stone mould 3. In this way, the operative connection between the core puller accommodation 8 and the core pullers 9 with their core puller mounts 10 is completely neutralized. Certainly, the core puller mounts 10 are within the core puller accommodation 8, but all around have a sufficient clearance, so that the core pullers 9 are only in contact with the stone mould 3.

Now, the core pullers 9 are almost symmetrically and freely uncoupled from the core puller device 2 in the stone mould 3. In the subsequent filling operation with concrete 25 and packing in this way no additional force component acts on the stone mould 3 except the vertical force component required for packing. The center of gravity of the core pullers 9 is located inside the stone mould 3. Thus, by neutralizing the operative connection an even more uniform packing of the concrete of the shaped stones is possible and at the same time the wear within the entire device is reduced.

After completion of the packing operation the core pullers 9 are retracted from the stone mould 3. For that, the drive 7 is pulled back, whereby the slide car 5 with the core puller accommodation 8 is moved away from the stone mould 3. In this way, the draw plate 20 abuts on the collar of the core puller mount 10. That is, there is established an operative connection between the core puller mounts 10 and the core puller accommodation 8 for retracting the core pullers 9. By further pulling back the drives 7 now the core pullers 9 are retracted from the stone mould 3 again. During the retraction the core puller bearing 11 travels upward again to vertically support the core pullers 9. Also, thereupon the swivel lever 16 again swivels into the upright position and thus, brings the core puller guide 12 back to the initial position to vertically and horizontally guide the core pullers 9. This operation has to be completed before the ends of the core pullers 9 leave the stone mould 3. In this way, it is ensured that the core pullers 9 can always be held in position. After the core pullers 9 have been retracted from the stone mould 3 the shaped stones can be carried away by the bolster plate 19.

LIST OF REFERENCE NUMBERS

1 block machine
2 core puller device
3 stone mould
4 rack
5 sliding facility (slide car)
6 guide rail
7 drive (hydraulic cylinder)
8 core puller accommodation
9 core puller
10 core puller mount
11 core puller bearing
12 core puller guide
13 opening
14 moulding cavity
15 height adjustment (lifting rack)
16 swivel lever
17 rotational point
18 drive (pneumatic cylinder)
19 bolster plate
20 draw plate
21 pressure plate
22 bearing (roller plate with ball transfer units)
23 drive (pneumatic cylinder)
24 retaining ring
25 concrete
A detail A
B detail B
C detail C

The invention claimed is:

1. A core puller device for a block machine having at least one core puller, comprising:

the at least one core puller configured to be inserted into and retracted from a stone mould of the block machine via a sliding facility of the core puller device, wherein an operative connection between the sliding facility and the at least one core puller is configured to be neutralized at least temporarily during at least a packing operation, wherein the sliding facility has a core puller accommodation that is configured such that the core puller accommodation at least partially surrounds at least one end of a core puller with a clearance, and wherein the clearance is (i) provided between the sliding facility and the at least one core puller and (ii) formed so that the core puller at least partially surrounded at the at least one end by the core puller accommodation is configured to vibrate with the stone mould of the block machine during the packing operation while being inserted into the stone mould.

2. The core puller device according to claim 1, wherein the core puller device has several core pullers extending in parallel.

3. The core puller device according to claim 1, wherein an end of at least one core puller is at least partially surrounded by the core puller accommodation and has an abutment that is formed as a collar.

4. The core puller device according to claim 3, wherein the collar is part of a core puller mount attached to the end of the core puller, the core puller mount being formed as a sleeve.

5. The core puller device according to claim 3, wherein the abutment for making the operative connection is formed such that the abutment abuts on the core puller accommodation when the sliding facility retracts the at least one core puller from the stone mould.

6. The core puller device according to claim 3, wherein the core puller accommodation has a draw plate on which the abutment of a core puller arranged in the core puller accommodation is configured to at least partially abut.

7. The core puller device according to claim 6, wherein the draw plate is formed as a coulisse with several crests on the crests of which the abutments of all core pullers arranged in the core puller accommodation at least partially abut.

8. The core puller device according to claim 1, wherein the core puller accommodation has a pressure plate on which a side of the end of a core puller arranged in the core puller accommodation is configured to abut when the core puller is inserted into the stone mould by the sliding facility.

9. The core puller device according to claim 8, wherein at least one bearing is attached to the pressure plate of the core puller accommodation to reduce a friction between the core puller accommodation and the at least one core puller.

10. The core puller device according to claim 1, wherein the core puller device has at least one core puller bearing that is movable.

11. The core puller device according to claim 10, wherein the movable core puller bearing is formed as a lever arranged at the sliding facility with which all of the core pullers arranged in the core puller accommodation are configured to be lifted simultaneously.

12. The core puller device according to claim 1, wherein the core puller device has a movable core puller guide that is swivel-mounted to a rack of the core puller device.

13. The core puller device according to claim 12, wherein the core puller guide is formed as an upwardly open coulisse in which all of the core pullers are laterally guided and supported in height.

14. The core puller device according to claim 1, wherein each of the sliding facility, the core puller bearing, and/or the core puller guide is configured to be moved by its own drive.

15. The core puller device according to claim 1, wherein the core puller device has a height adjustment that is formed as a movable lifting rack with which the height of the core puller device, including that of the core pullers, is configured to be adjusted relative to the block machine and to its stone mould.

16. The core puller device according to claim 1, wherein the sliding facility is formed as a slide car that is movable via guide rails attached to a rack of the core puller device in a guided manner.

17. A block machine, comprising a core puller device having at least one core puller, wherein the at least one core puller is configured to be inserted into and retracted from a stone mould of the block machine via a sliding facility of the core puller device, wherein an operative connection between the sliding facility and the at least one core puller is configured to be neutralized at least temporarily during at least a packing operation, wherein the sliding facility has a core puller accommodation that is configured such that the core puller accommodation at least partially surrounds at least one end of a core puller with a clearance, and wherein the clearance is (i) provided between the sliding facility and the at least one core puller and (ii) formed so that the core puller at least partially surrounded at the at least one end by the core puller accommodation is configured to vibrate with the stone mould of the block machine during the packing operation while being inserted into the stone mould.

18. A method for preparing shaped stones with a block machine having a core puller device, wherein the core puller device comprises at least one core puller arranged on a sliding facility of the core puller device, the at least one core puller being temporarily inserted into a stone mould of the block machine and retracted after a packing operation in the block machine, wherein an operative connection between the at least one core puller and the sliding facility of the core puller device is neutralized at least temporarily during at least the packing operation, and wherein the operative connection during the packing operation is neutralized such that an end of the at least one core puller that faces the core puller device is configured to vibrate in the core puller device, the vibration being performed by means of a clearance that (i) is provided between the sliding facility and the at least one core puller and (ii) at least partially surrounds the end of the at least one core puller.

19. The method for preparing shaped stones according to claim 18, wherein the operative connection is neutralized and established by traversing and/or swiveling a part of the core puller device, including a core puller bearing and/or a core puller guide.

20. The method for preparing shaped stones according to claim 18, wherein at least one core puller is at least temporarily vertically supported and/or horizontally guided during the insertion into and/or retraction from the stone mould by at least one core puller guide.

21. The method for preparing shaped stones according to claim 18, wherein at least one core puller is temporarily vertically supported during the insertion into and/or retraction from the stone mould by at least one core puller bearing, wherein the core puller bearing is moved together with the sliding facility when performing the insertion and/or retraction.

22. The method for preparing shaped stones according to claim 18, wherein the vertical position of the core puller device relative to the stone mould is adjusted via a height adjustment before the at least one core puller is inserted into the stone mould.

* * * * *